US011805868B2

(12) United States Patent
Talasazan

(10) Patent No.: US 11,805,868 B2
(45) Date of Patent: Nov. 7, 2023

(54) SYSTEM AND METHOD FOR A RING WITH DESIGN INSERT ON INNER SURFACE

(71) Applicant: Goel Talasazan, Los Angeles, CA (US)

(72) Inventor: Goel Talasazan, Los Angeles, CA (US)

( * ) Notice: Subject to any disclaimer, the term of this patent is extended or adjusted under 35 U.S.C. 154(b) by 153 days.

(21) Appl. No.: 17/354,844

(22) Filed: Jun. 22, 2021

(65) Prior Publication Data

US 2021/0401129 A1 Dec. 30, 2021

Related U.S. Application Data

(60) Provisional application No. 63/044,915, filed on Jun. 26, 2020.

(51) Int. Cl.
*A44C 9/00* (2006.01)
*A44C 27/00* (2006.01)

(52) U.S. Cl.
CPC ..... *A44C 9/0053* (2013.01); *A44C 9/0084* (2013.01); *A44C 27/00* (2013.01)

(58) Field of Classification Search
CPC ..... A44C 17/02; A44C 9/0084; A44C 27/00; A44C 9/00; A44C 9/0053; A44C 9/0061; A44C 15/004; A44C 17/0208
See application file for complete search history.

(56) References Cited

U.S. PATENT DOCUMENTS 4,912,944 A * 4/1990 Crosley ..... A44C 17/02 63/29.1
2009/0071192 A1* 3/2009 Bauman ..... A44C 17/046 63/26
2014/0123702 A1* 5/2014 Pierce ..... A44C 15/00 156/267
2015/0359304 A1* 12/2015 Thomas ..... A44C 5/003 63/3
2017/0086534 A1* 3/2017 Ract ..... A44C 7/002

FOREIGN PATENT DOCUMENTS

FR 3067909 B1 * 1/2021 ..... A44C 5/0023
KR 20150007470 A * 7/2013

* cited by examiner

*Primary Examiner* — Jack W Lavinder
(74) *Attorney, Agent, or Firm* — Keith Miller Patent Law, PLLC; Keith A. Miller

(57) ABSTRACT

A ring design insert, comprising a ring further comprising an inner surface and an outer surface; a mounting section on the inner surface of the ring; and a design insert configured to fit within the mounting section. The design insert is secured within the mounting section on the inner surface of the ring shank. The design insert further comprises a combination of letters, numbers, and/or symbols. A method for installing a design insert on a ring comprising the steps placing at least one design insert on an inner surface of a ring, wherein the design insert is configured to fit within a mounting section on the inner surface of the ring; and securing the at least one design insert within the mounting section.

14 Claims, 5 Drawing Sheets

SYSTEM AND METHOD FOR A RING WITH DESIGN INSERT ON INNER SURFACE

CROSS-REFERENCE TO RELATED APPLICATIONS

The present application is related to and claims the benefit under 35 U.S.C § 119(e) of the prior U.S. provisional application Ser. No. 63/044,915 filed Jun. 26, 2020 entitled "RING WITH INNER SHANK DECORATIVE INLAY", the contents of which are incorporated herein by this reference in their entirety and are not admitted to be prior art with respect to the present invention by the mention in this cross-reference section.

FIELD OF THE INVENTION

The present invention generally relates to jewelry, specifically to rings with design inserts and settings on the inner surface of the ring.

BACKGROUND OF THE INVENTION

Jewelry items such as rings have traditionally been designed with inlays, designs, and stone settings configured to be shown on an outer surface of the ring band and/or ring shank. However, the inner surface of the ring shank, the surface interacting with the skin of the ring wearer, is starting to be decorated in some fashion. The most common forms of decoration are design impressions and/or engravings of significance, such as important dates or terms of endearment.

The problem with these forms of decoration on the inner surface of the ring shank is that over time the metal will wear down and the impression or engraving is slowly removed due to ring movement against the skin. Unlike an impression or engraving, which can be done on a preexisting ring band or shank, a design insert and/or stone setting on the inner surface of the ring shank will not wear down. However, the design insert and/or stone setting has to be designed such that the design insert and/or stone setting does not extend too far beyond the inner surface of the ring shank such as to interact with the finger and skin of the ring wearer. Additionally, the width and thickness of the ring shank has to be designed such that the design insert and/or stone can successfully be mounted onto the ring shank.

BRIEF SUMMARY OF THE INVENTION

The present invention overcomes the problems cited above by providing a system and method for a ring with a design insert on an inner surface, such that the design insert is visible from the inner surface of the ring. The design insert is configured to fit within a mounting section located on the inner surface of the ring.

An object of the present invention provides a design insert for a ring comprising a ring further comprising an inner surface and an outer surface, a mounting section on the inner surface of the ring, and a design insert configured to fit within the mounting section. The design insert is secured within the mounting section on the inner surface of the ring.

Another object of the present invention provides a design insert further comprising a base layer configured to fit on an inner surface of a ring and a decorative layer mounted on top of the base layer. The base layer is preferably comprised of a metal material, such as steel, silver, or gold. The decorative layer is preferably comprised of an enamel material and may further comprise a precious and/or semi-precious stone.

Another object of the present invention provides the design insert is comprised of a series of letters, numbers, and/or symbols. The series of letters, numbers, and/or symbols may spell out a message.

Another object of the present invention provides the design insert is comprised of a setting and precious and/or semi-precious stone.

Another object of the present invention provides a design insert at the bridge of a ring, on the inside surface of a ring setting.

Another object of the present invention provides a method of installing a design insert on a ring comprising the steps: placing at least one design insert on an inner surface of a ring shank, wherein the design insert is configured to fit on the inner surface of the ring shank; and securing the at least one design insert onto the inner surface of the ring shank.

Another object of the present invention provides the additional step of removing material from the inner surface of the ring shank to create a mounting section, wherein the design insert is configured to fit within the mounting section.

BRIEF DESCRIPTION OF THE DRAWINGS

The particular objects and features of the invention as well as the advantages will become apparent from the following description taken in connection with the accompanying drawings in which.

DETAILED DESCRIPTION OF THE INVENTION

The following description of the preferred embodiments of the invention is intended to enable someone skilled in the prior art to make and use this invention but is not intended to limit the invention to these preferred embodiments.

For purposes of this application, a ring is comprised of a shank, which is the technical term for the band of metal that encircles the finger. A ring may further comprise a head, or setting, which holds the gemstone. Additionally, on rings with a head or setting, a gallery or bridge is the back side of the ring setting that fits against the top of the finger.

Figure 1:
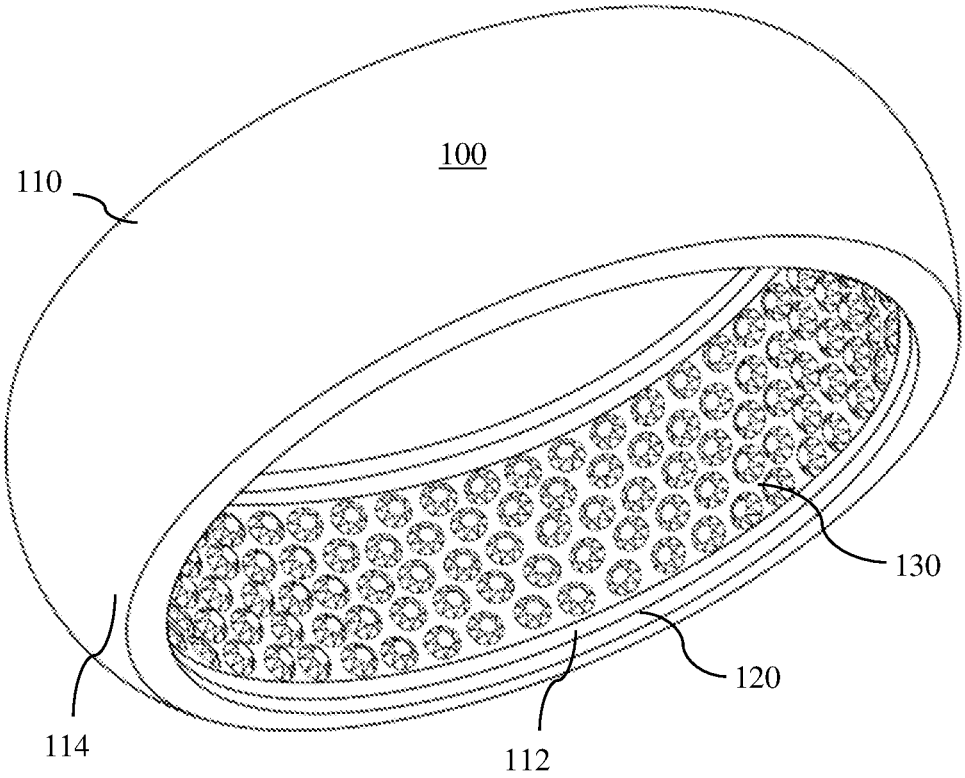
FIG. 1 is a perspective view for a SYSTEM AND METHOD FOR A RING WITH DESIGN INSERT ON INNER SURFACE according to an embodiment of the present invention.

Referring now to the attached drawings, the present invention as shown in FIG. 1 is a ring design insert comprising a ring 110 further comprising an inner surface 112 and an outer surface 114, a mounting section 120 on the inner surface 112 of the ring 110, and a design insert 130 configured to fit within the mounting section 120. The design insert 130 is preferably attached within the mounting section 120 on the inner surface of the ring.

As further shown in FIGS. 1-5, the mounting section 120 comprises a portion of the inner surface of the ring. In some embodiments, the mounting section 120 is a cavity in the ring inner surface 112, the cavity 140 configured to allow the design insert 130 to fit within. In other embodiments, the cavity further comprises a setting configured to hold a precious or semi-precious stone. In other embodiments, the mounting section 120 is a channel 122 around the circumference of the inner surface 112 of a ring.

Figure 4:
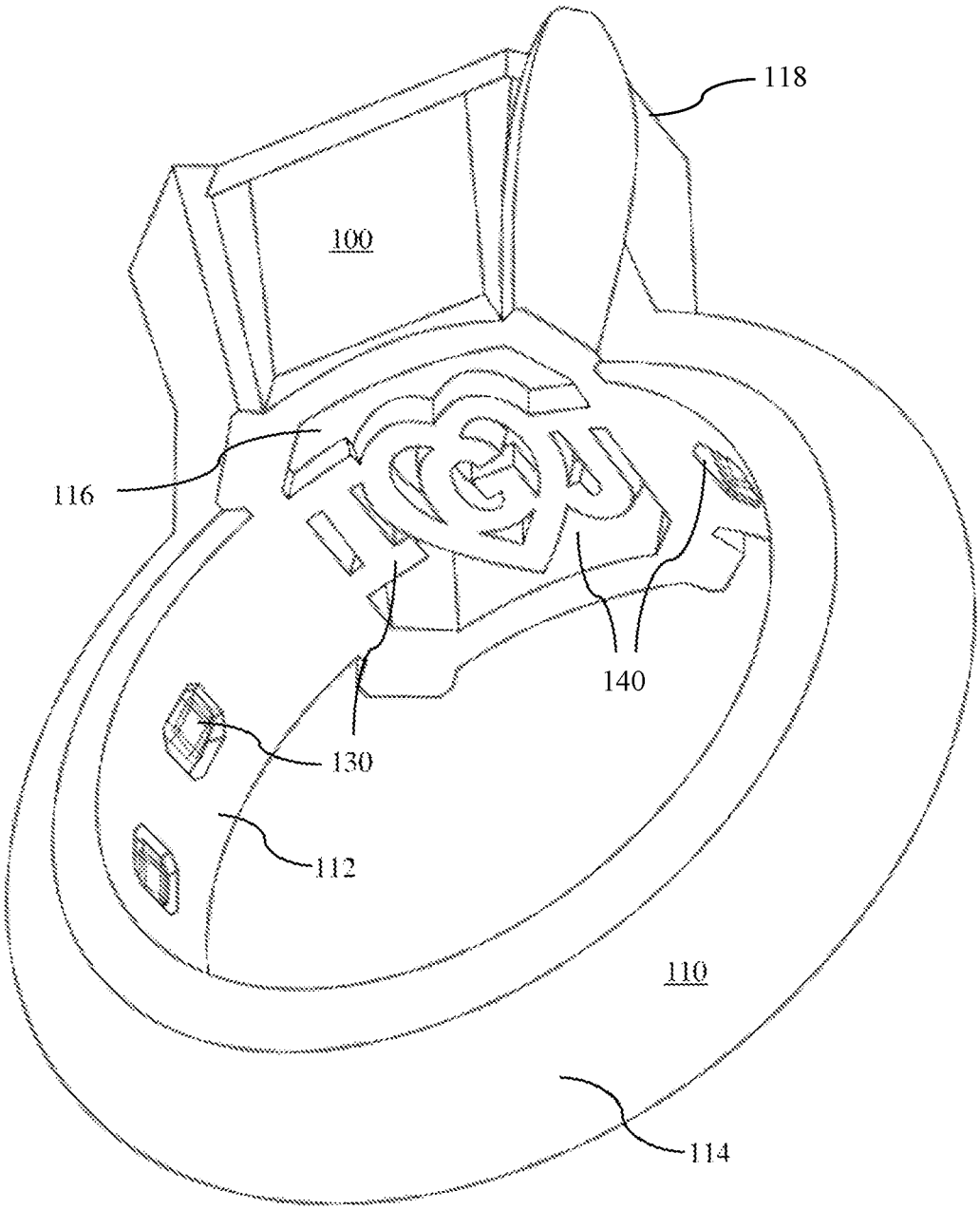
FIG. 4 is a bottom perspective view for a SYSTEM AND METHOD FOR A RING WITH DESIGN INSERT ON INNER SURFACE according to an embodiment of the present invention.
Figure 5:
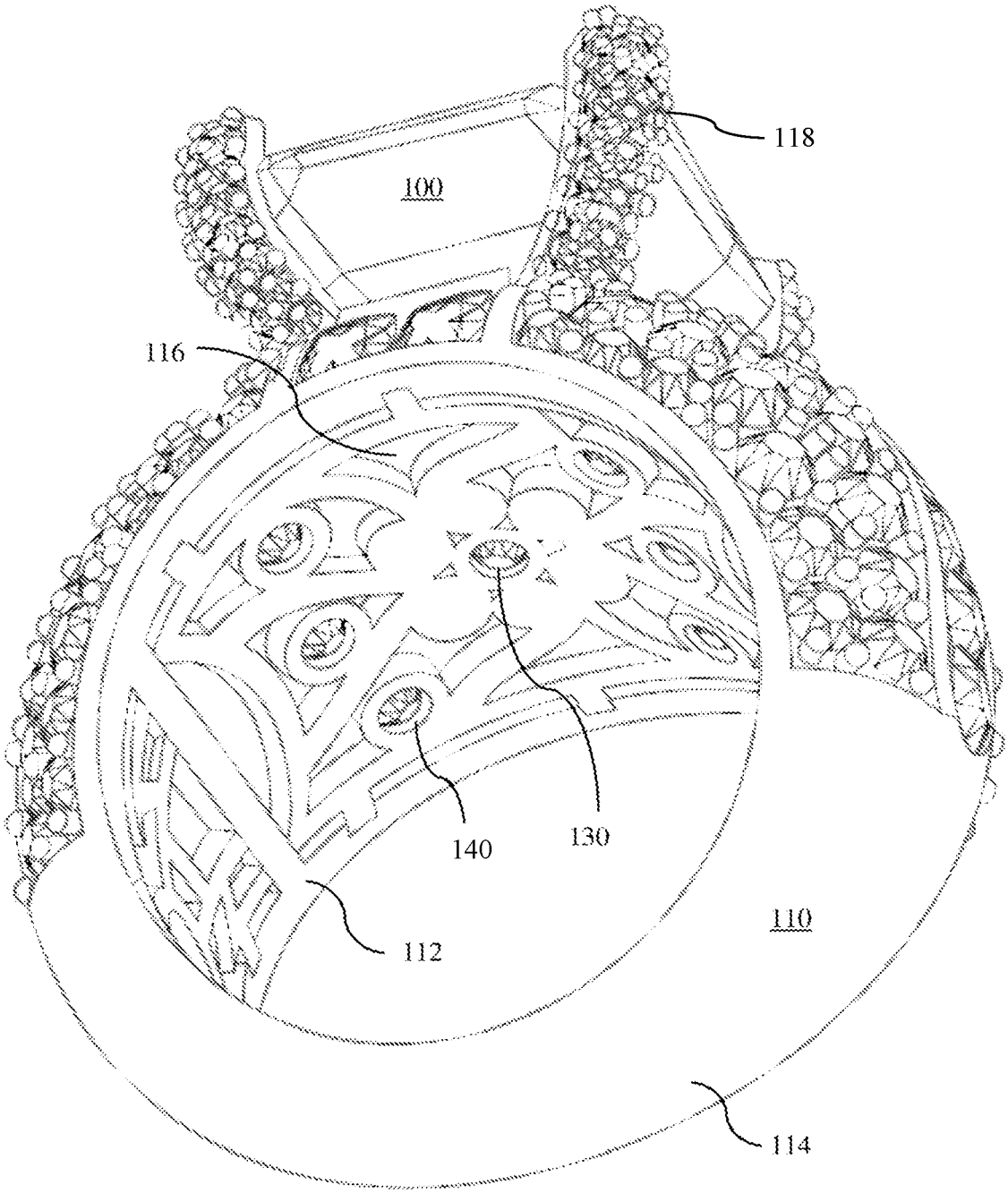
FIG. 5 is a bottom perspective view for a SYSTEM AND METHOD FOR A RING WITH DESIGN INSERT ON INNER SURFACE according to an embodiment of the present invention.

As further shown in FIGS. 4-5, in some embodiments where the ring comprises a setting, the mounting section 120 is in the gallery 116 of the ring 100, the area under the main setting 118. In this embodiment, the design insert 130 is configured to fit within the gallery 116 mounting section 120.

As further shown in FIGS. 1-5, the design insert 130 is configured to be generally semi-circular to match the concave curvature of the ring 110 inner surface 112. The design insert 130 is preferably secured within the mounting section 120 of the ring such that the design insert 130 may or may not have movement when in place. The design insert 130 is configured to fit within the mounting section 120 such that the design insert 130 does not extend past the inner surface 112 of the ring 110.

In some embodiments, as shown in FIGS. 1-5, the design insert 130 is preferably comprised of a specific design. In other embodiments, the design insert 130 is preferably comprised of a series of numbers, letters, and/or symbols. In these embodiments, the series of numbers, letters, and/or symbols are configured into a design or phrase with some meaning to owner of the ring 100.

The design insert 130 is preferably comprised of metal. In one embodiment, the design insert 130 is comprised of steel. In other embodiments, the design insert 130 is comprised of a precious metal that the ring is made of, such as silver or gold, or a contrasting material. In other embodiments, the design insert 130 is comprised of other materials consistent with jewelry.

In another embodiment, the design insert 130 is preferably comprised of a base layer 132 and a decorative layer 134. The decorative layer 134 is mounted to a top portion of the base layer. The base layer 132 is preferably configured to fit within the mounting section 120. The base layer 132 is preferably comprised of metal, such as steel, or precious metal such as silver or gold.

The decorative layer 134 is preferably comprised of an enamel material. In some embodiments, the decorative layer 134 is preferably comprised of at least one setting for precious and/or semi-precious stones. In yet other embodiments, the decorative layer 134 is preferably comprised of a plurality of settings configured into a shape, such as a heart or combination of letters, numbers, and/or symbols. The decorative layer 134 may also be comprised of other materials not enumerated herein.

In some embodiments, the design insert 130 preferably comprises diamonds and/or other valuable precious and/or semi-precious stones such as rubies, emeralds, or sapphires. In other embodiments, the design insert 130 may be comprised of an enamel material. The design insert 130 may be comprised a metal, precious metal or other types of metal, formed into one or more words, formed into numbers to express a message of sentiment, or a combination of words, numbers and/or symbols. Messages such as "I love you" or "I ♥ U", or a date that signifies importance such as "1-25-15". Other dates and messages may be considered that are not named herein. Further, the words, numbers, and/or symbols may be encrusted with precious or semi-precious stones.

Figure 2:
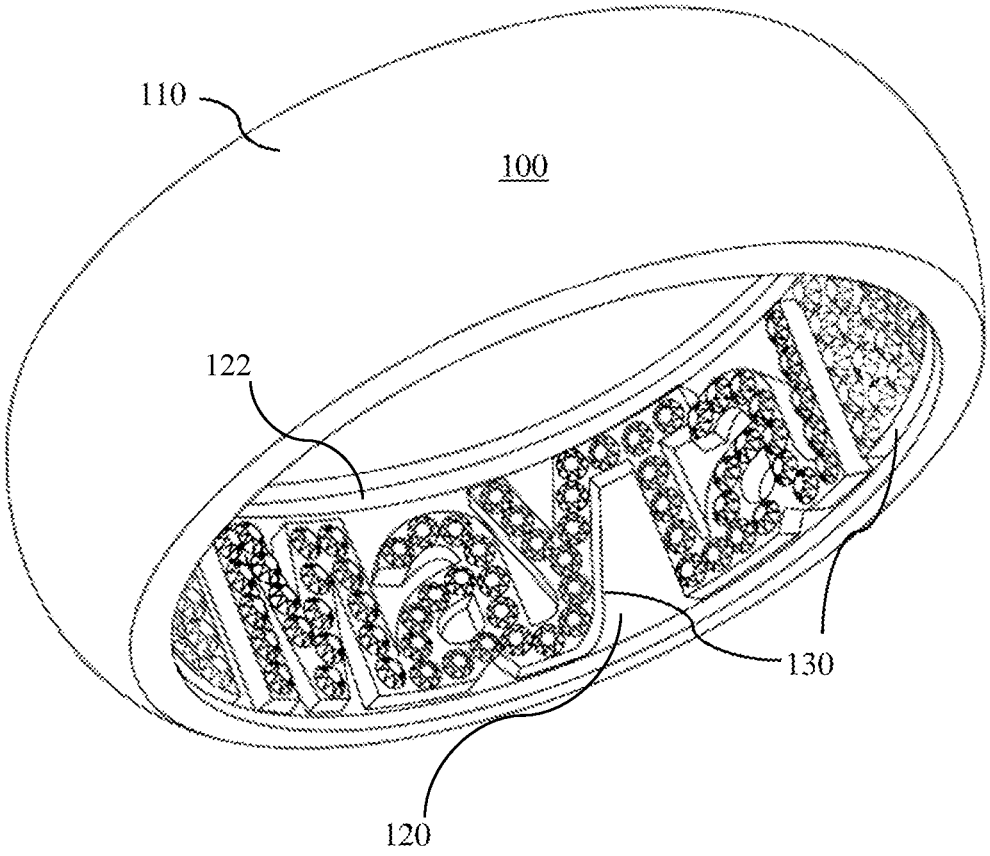
FIG. 2 is a perspective view of a SYSTEM AND METHOD FOR A RING WITH DESIGN INSERT ON INNER SURFACE according to an embodiment of the present invention.
Figure 3:
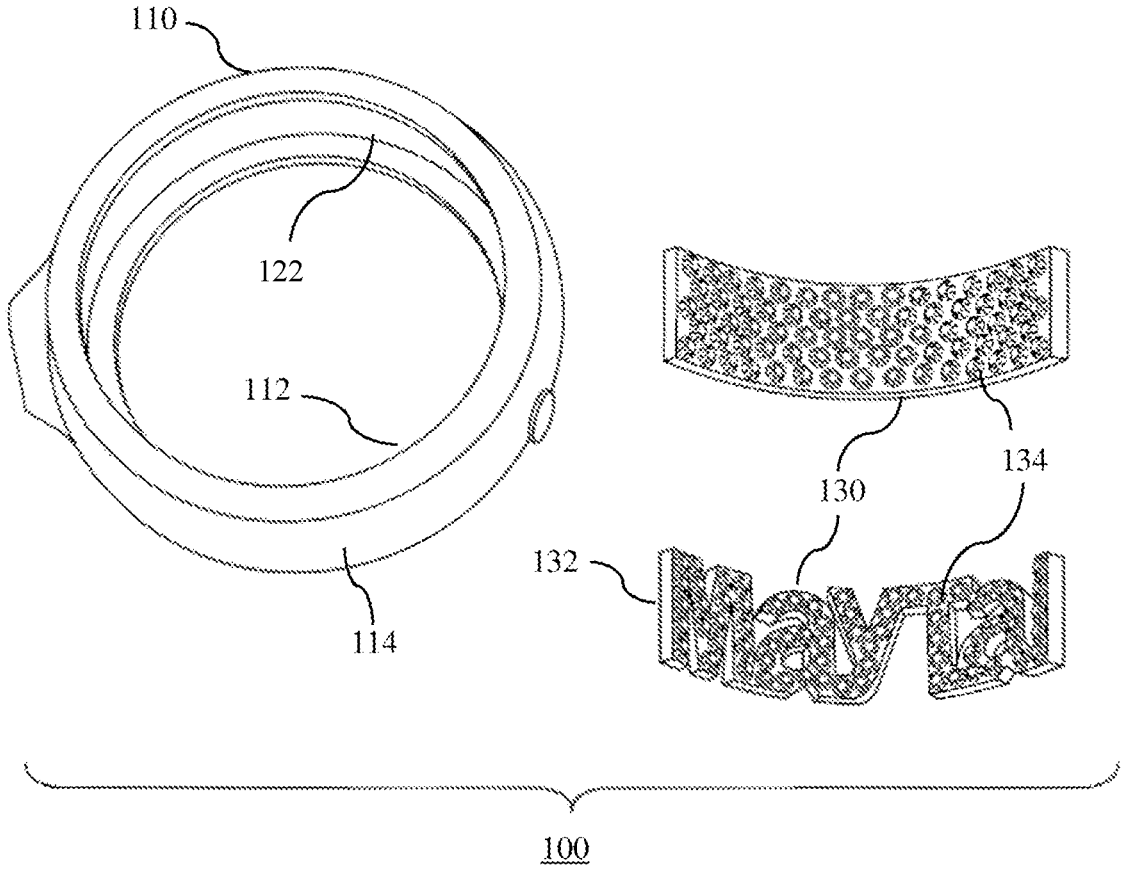
FIG. 3 is a perspective view of a ring and design inserts for a SYSTEM AND METHOD FOR A RING WITH DESIGN INSERT ON INNER SURFACE according to an embodiment of the present invention.

As further shown in FIGS. 1-3, the mounting section 120 the ring 110 of the ring is preferably designed with more width than normal and a portion is hollowed out to create a channel to hold the design insert 130. The design insert 130 is preferably shaped like an open or spread "C", or semi-circular shaped such that the design insert 130 matches the curvature of the ring 110. The design insert 130 may be multiple pieces that can be fit together onto the inner surface 112, or within the channel created, of the ring 110.

The design insert 130 is preferably configured to fit within the hollowed out portion of the ring 110, such as being in a semi-circular shape designed to fit within the ring 110. The design insert 130 is preferably secured within the mounting section 120 by lasering, soldering, or other methods not enumerated herein. The design insert 130 may or may not be able to move within the mounting section 120 after being secured.

Alternatively, the design insert 130 is preferably press fit into the mounting section 120. In this embodiment, the sidewalls of the mounting section 120 on either side of the hollowed out portion are slightly spread apart, the design insert 130 installed, then the sidewalls are released to fit tightly against the design insert 130 holding it in place. Alternately, the design insert 130 is simply pressed into the mounting section 120 to secure the design insert 130 in place.

In one embodiment, the design insert 130 further comprises a tracking device 180. The tracking device 180 preferably comprises a microchip comprising a global positioning system (GPS) configured to send and receive signals for alerting a user of the location of the ring in which the design insert is installed. In one embodiment, the tracking device 180 is preferably embedded in the design insert. In another embodiment, the tracking device 180 is a design element of the design insert. In another embodiment, the tracking device 180 is located between the base layer and decorative layer.

In some embodiments, the tracking device further comprises a wireless communication system electronically connected to the GPS such that the tracking device will send location information based on the GPS using the wireless communication system. Preferably, the tracking device is compatible with a mobile wireless device with an app configured to connect with the tracking device. Preferably, the wireless connection between the app and the tracking device is encrypted to prevent others from accessing the tracking device information.

In some embodiments, the tracking device further comprises a touch sensor configured to activate the tracking device when the touch sensor is not in contact with a wearer's skin.

A method for installing a design insert 130 on a ring 110 comprising the steps of placing at least one design insert 130 on an inner surface 112 of a ring 110, where the design insert is configured to fit within a mounting section 120 on the inner surface 112 of the ring 110, and securing the at least one design insert 130 within the mounting section 120.

The design insert 130 is preferably configured to fit within the mounting section 120 on the inner surface 112 of the ring 110 such that the design insert 130 does not extend past the inner surface 112 of the ring 110. As described above, the design insert 130 could be a semi-circular piece that fits within a channel on the inner surface of the ring. In an alternate embodiment, the design insert 130 could be a stone setting that contains a precious or semi-precious stone. In this embodiment, the stone setting would be the base layer as described herein and the precious or semi-precious stone would be the decorative layer.

Securing the design insert 130 preferably comprises lasering, soldering, or other method of securing the design insert to the inner surface of the ring within the mounting section. In another embodiment, securing the design insert 130 comprises securing the base layer within the mounting section 120. In an alternate embodiment, securing the design insert 130 comprises a press fit within the mounting section 120. Securing the design insert may comprise setting a gemstone into a setting where the setting is secured within the mounting section 120.

In another embodiment, the method for installing a design insert 130 further comprises the step of removing material from the inner surface 112 of the ring shank 110 to create the mounting section, wherein the design insert 130 is configured to fit within the mounting section created by removing material. The methods for removing material may comprise milling, drilling, and any other method common for jewelry for removing material from the inner surface of the ring not enumerated herein.

In another embodiment, the method further comprises the step of arranging at least one design element on the outside surface of the ring such that a shadow design, or bleeding, is created on the inner surface of the ring to interact with the design insert. In this step, the design elements are preferably various types of stone settings, carvings, and other features not enumerated herein.

Although the present invention has been described by way of example, it should be appreciated that variations and modifications may be made without departing from the scope of the invention. Furthermore, where known equivalents exist to specific features, such equivalents are incorporated as if specifically referred to in this specification.

What is claimed is:

1. A ring design insert, comprising:

a ring further comprising an inner surface and an outer surface;

a mounting section on the inner surface of the ring; and a design insert configured to fit within the mounting section, the design insert comprising a base plate configured to fit within the mounting section, and a decorative layer on top of the base plate;

wherein the decorative layer further comprises a plurality of settings configured to retain precious or semi-precious stones; and wherein the design insert is secured within the mounting section on the inner surface of the ring.

2. The ring design insert of claim 1, wherein the mounting section is a channel around the ring inner surface configured to accept the design insert.

3. The ring design insert of claim 1, wherein the mounting section further comprises a cavity on the inner surface, the cavity configured to accept a design insert.

4. The ring design insert of claim 3, wherein the cavity comprises a setting configured to retain a precious or semi-precious stone.

5. The ring design insert of claim 1, wherein the mounting section is configured to retain a plurality of design inserts.

6. The ring design insert of claim 1, wherein the design insert further comprises a combination of letters, numbers, and/or symbols.

7. The ring design insert of claim 1, wherein the design insert is press fit within the mounting section.

8. A design insert for a ring, comprising:

a base layer configured to attach on an inner surface of a ring; and a decorative layer mounted on top of the base layer, the decorative layer further comprises a plurality of settings configured to retain precious or semi-precious stones;

wherein the ring further comprises a mounting section on the inner surface.

9. The design insert of claim 8, wherein the mounting section is a channel around the ring inner surface configured to accept the design insert.

10. The design insert of claim 8, wherein the mounting section further comprises a cavity on the inner surface, the cavity configured to accept a design insert.

11. The design insert of claim 10, wherein the base layer is a setting configured to retain the decorative layer comprising a precious or semi-precious stone.

12. The design insert of claim 8, wherein the decorative layer further comprises an enamel material.

13. The design insert of claim 8, wherein the base layer comprises a combination of letters, numbers, and/or symbols.

14. The design insert of claim 8, wherein the base layer is configured to be press fit into the mounting section.

* * * * *